US007313836B1

(12) United States Patent
Swezey et al.

(10) Patent No.: US 7,313,836 B1
(45) Date of Patent: Jan. 1, 2008

(54) FREE-STANDING RECLINING BED LOUNGE

(76) Inventors: Robert L. Swezey, 10532 Garwood Pl., Los Angeles, CA (US) 90024; Richard Swezey, 1328 16th St., Santa Monica, CA (US) 90404

( * ) Notice: Subject to any disclaimer, the term of this patent is extended or adjusted under 35 U.S.C. 154(b) by 0 days.

(21) Appl. No.: 11/543,657

(22) Filed: Oct. 6, 2006

(51) Int. Cl.
*A47C 20/04* (2006.01)
*A47C 1/024* (2006.01)

(52) U.S. Cl. ..... 5/634; 5/633; 297/230.1; 297/230.14; 297/354.12

(58) Field of Classification Search ..... 5/633, 5/632, 634, 630, 653, 652, 613–617; 297/377, 297/380, 352, 61, 301.1, 301.3, 230.1, 230.12, 297/230.14, 354.12
See application file for complete search history.

(56) References Cited

U.S. PATENT DOCUMENTS

| | | | | | |
|---|---|---|---|---|---|
| 471,895 | A | * | 3/1892 | Reeves | 5/634 |
| 484,974 | A | * | 10/1892 | Parker | 5/634 |
| 773,381 | A | * | 10/1904 | Fields | 5/634 |
| 969,351 | A | * | 9/1910 | La Dow | 5/634 |
| 1,098,126 | A | * | 5/1914 | Reich | 5/634 |
| 2,105,336 | A | * | 1/1938 | Smith | 5/632 |
| 2,107,962 | A | * | 2/1938 | Sheasby | 5/638 |
| 2,304,700 | A | * | 12/1942 | Manville | 297/188.04 |
| 2,461,434 | A | * | 2/1949 | Moyers | 5/632 |
| 2,496,592 | A | * | 2/1950 | Morgan | 5/634 |
| 2,509,040 | A | * | 5/1950 | Kibbe | 297/255 |
| 2,666,216 | A | * | 1/1954 | Schnaitter | 5/660 |
| 2,713,890 | A | * | 7/1955 | Mack | 297/31 |
| 2,788,529 | A | * | 4/1957 | Moritzacky et al. | 5/634 |
| 3,137,012 | A | * | 6/1964 | Halterman | 5/633 |
| 3,273,174 | A | * | 9/1966 | Cassini | 5/633 |
| 3,931,653 | A | * | 1/1976 | Bien | 5/634 |
| 4,458,370 | A | * | 7/1984 | Fickler | 5/660 |
| 4,522,446 | A | | 6/1985 | Sheridan | |
| 4,672,696 | A | | 6/1987 | Horenkamp | |
| 4,754,507 | A | * | 7/1988 | Edge | 5/633 |
| 4,829,611 | A | | 5/1989 | Fireman et al. | |
| 5,110,183 | A | | 5/1992 | Jeanes, III | |
| 5,197,781 | A | | 3/1993 | Tada | |
| 5,230,113 | A | | 7/1993 | Foster et al. | |
| 5,267,363 | A | | 12/1993 | Chaffee | |
| 5,367,726 | A | | 11/1994 | Chaffee | |
| 5,423,098 | A | | 6/1995 | Swezey | |

(Continued)

FOREIGN PATENT DOCUMENTS

WO WO 9325123 A1 * 12/1993

*Primary Examiner*—Robert G. Santos
(74) *Attorney, Agent, or Firm*—J. E. McTaggart

(57) ABSTRACT

A compact free-standing reclining bed lounge, expanding a product line marketed under BedLounge®, is made with a removable fabric slip-cover enclosing foam and fiber padding covering a basic seat structure formed from air-core plastic sheet material utilizing "living" hinges and reinforced by fabric webbing. The lounge is portable, sturdy, light-weight and free-standing, requiring no external support such as a headboard or wall, and provides reclining capability over a wide range, easily adjustable by a user while seated. A cam-lever gripping mechanism, in a slidable assembly on a pair of rear support columns, normally holds the lounge fixed at the previously selected inclination. To readjust the inclination, the user, by pulling a control strap, temporarily releases the gripping and allows the inclination to be readjusted by shifting of the user's body position and weight.

9 Claims, 4 Drawing Sheets

U.S. PATENT DOCUMENTS 5,425,150 A * 6/1995 Palmer et al. ..... 5/615
5,425,567 A * 6/1995 Albecker, III ..... 297/377
5,806,115 A * 9/1998 Brown ..... 5/615
5,882,079 A * 3/1999 Yang ..... 297/377
5,926,876 A * 7/1999 Haigh et al. ..... 5/617
5,937,459 A * 8/1999 Binaghi et al. ..... 5/634
6,035,464 A 3/2000 Williams
6,138,303 A 10/2000 Alvestad
6,230,345 B1 5/2001 Borrero et al.
6,374,440 B1 4/2002 Thim, Jr.
6,438,777 B1 * 8/2002 Bender ..... 5/630
6,568,088 B1 * 5/2003 Ende ..... 30/371

* cited by examiner

FREE-STANDING RECLINING BED LOUNGE

FIELD OF THE INVENTION

The present invention relates to household accessory furniture for providing back support to a user seated on a flat surface such as bed, sofa or floor and more particularly it relates to a free-standing BedLounge® that can be easily user-adjusted to any desired inclination in a wide range provided from an upright position to a substantially reclined position, and that will remain secured at the inclination selected.

BACKGROUND OF THE INVENTION

For those who spend periods of time sitting in a bed, sofa or other flat surface such as a floor or ground, it is important to provide proper support to the body to avoid discomfort, fatigue and/or body deformation. Ordinary cushions and pillows fail to provide necessary support, which requires a chair-like bed lounge typically with at least a rear portion with two attached arm-rests, one at each side, and preferably a neck support/headrest.

To accommodate the needs of different individuals with regard to size, body shape, weight, age, etc., the bed lounge is preferably provided with several user adjustment capabilities, e.g. relating to tilt-back, arm-rest spacing, lower back support, headrest height and orientation.

Bedding furniture in the field of this invention has been known under such names as "bed bolster", "husband" and "study rest". Typically such items have been made entirely from foam, loose-filling or fiber material so that characteristically they lack support, being overly soft and flexible, and/or they are inconveniently heavy.

U.S. Pat. No. 5,423,098 issued to the present inventors, hereby incorporated by reference, disclosed an ergonomic BED LOUNGE made with a fabric cover enclosing foam padding over a main seat assembly formed from air-core plastic sheet material to provide the required strength while keeping the weight lighter than all-foam construction. This original version of the BedLounge® featured a basic form of limited adjustable inclination, a built-in adjustable lower back pillow, a doubly adjustable neck/head pillow and arm-rests have pivoted forward portions with "living hinges" for adjusting separation. Subsequent developments in the BedLounge® product line are disclosed in currently pending U.S. patent application Ser. Nos. 11/240,538 filed Sep. 30, 2005 for DUAL-MODAL-SHAPE BED LOUNGE and 11/473,485 filed Jun. 23, 2006 for BASIC BED LOUNGE.

Many products in this field of endeavor fail to provide adjustable inclination; those that do provide such capability, including the previous three versions of the BedLounge® mentioned above, depend upon external support from a vertical structure such as a wall or the headboard of a bed and thus are not free-standing.

Known mechanisms for adjusting recliners, such as sun cots, hospital beds and the like, tend to be, excessively bulky, costly and/or heavy, impossible or highly inconvenient and difficult for a seated user to release, adjust and reset. Known lounges made of metal and/or electrically powered may pose risk of injury. Many known lounges are not fully adjustable over a continuous range of recline, providing only a limited number of detents or stops and/or inadequate range.

There remains an unfulfilled need for a compact, portable bed lounge that provides a wide continuous range of inclination that can be conveniently and proportionally adjusted by a user while seated in place, and that is free-standing without need for external support.

OBJECTS OF THE INVENTION

It is a primary object to provide a bed lounge that, in addition to the basic features of previous versions of the BedLounge®, has the additional capability of free-standing on any reasonably flat level surface without need for external support from vertical structure such a wall or headboard of a bed.

It is a further object to provide the free-standing version with self-contained structure and mechanism that allows the inclination, i.e. the angle of recline, of the lounge to be adjustable over a range from zero, i.e. upright, to >60 degrees, i.e. <30 degrees from horizontal.

It is a further object to provide a user control element that (1) can be manipulated by the user from a seated position in the lounge to enable adjustment of inclination conveniently and proportionally to any desired inclination in the range provided, and (2) when released, reintroduces the normal mode wherein the lounge is held firmly at the selected inclination.

SUMMARY OF THE INVENTION

The above mentioned and other objects and advantages have been realized in a free-standing bed lounge structured with a tail piece, extending from the lower rear region of the rear panel, attached to a pair of support columns that are slidably attached to an upper region of the rear panel, enabling the lounge to be reclined more than 60 degrees from upright and yet to remain free-standing on any flat surface without the conventional reliance on external vertical structure such as a wall or headboard of a bed. A selected inclination becomes automatically "locked" in place by a gripping mechanism in a slider assembly hingedly attached to the top region of the rear panel and slidably engaging the support columns. A pair of lever-cams are spring-loaded to grip onto the columns with friction pads and maintain a selected inclination in the normal mode. This gripping action can be released for readjustment of the inclination by the user from the seated position by pulling a control strap that initiates the adjustment mode by rotating the lever-cams to release the grip, thus allowing the user to select a different inclination while continuing to pull on the control strap. Then when the user releases the tension on the control strap, the spring-loaded lever-cams once again grip the columns with the friction pads to reinstate the normal mode with the lounge held firmly at the selected inclination.

The materials and compact structure of the lounge, especially those of the seat assembly, tailpiece and gripping mechanism accomplish an unusual combination of ruggedness, ease of manufacture and light weight.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
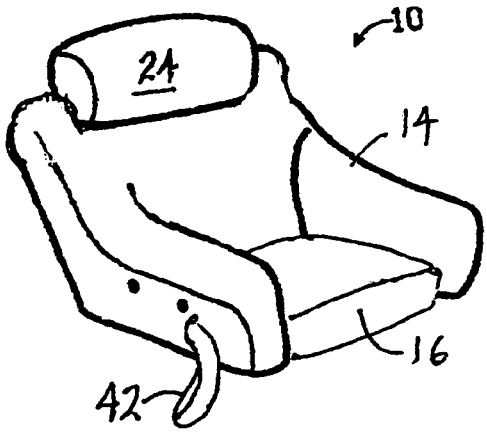
FIG. 1 is a perspective view showing the outline of a lounge of the present invention in an upright setting.

FIG. 1 shows, in a three-dimensional perspective view, an outline of a reclining free-standing Bed lounge 10 of the present invention, showing the general external appearance of an illustrative embodiment with the inclination set to zero, i.e. fully upright. Seat cushion 16 is retained in place by adjustable woven fabric straps located underneath and thus not visible in this view, serving to stabilize the lounge to the underlying horizontal support surface by utilizing the body shape and weight of the user. The adjustable straps provide an additional element of adjustable cushioning.

In the normal mode as shown, an internal mechanism provides a gripping action that continuously holds the inclination of the lounge effectively "locked" to the previous setting, in this case in the upright setting shown. The control strap 42 extending to a looped end from an opening in an arm rest of the slip cover, as shown, provides the user with ability to conveniently release the normal gripping action while remaining comfortably seated, initiating an adjustment mode wherein, by body repositioning and shifting the body weight, the lounge can be readjusted to any desired inclination in the wide range provided. Upon release of the control strap, the gripping action is automatically restored and the lounge is held "locked" at the newly selected inclination for usage in the normal mode.

Figure 2:
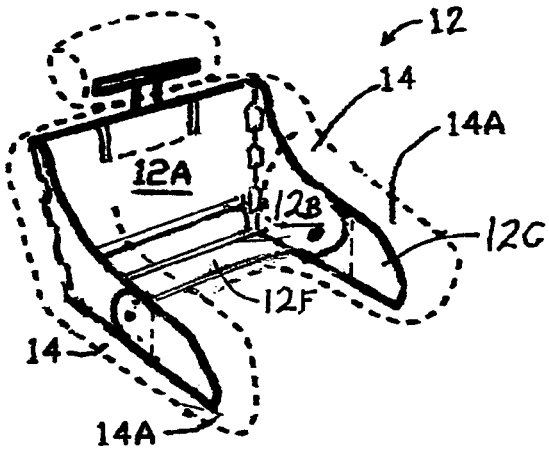
FIG. 2 is perspective view of the outline of the basic seat assembly of the lounge of FIG. 1, indicating the outline of the padding and slip cover in broken lines.

FIG. 2 is perspective view of the outline of the basic seat assembly 12 of the lounge 10 of FIG. 1, with the fabric covering and padding shown in broken lines. The main structural panels including rear panel 12A, side panels 12B, forward arm rest portions 12C and bottom panel 12F are fabricated from flat sheets of air core plastic approximately ¼ inch thick made in an extrusion process with multiple parallel passageways providing superior strength and light weight, plus the capability of embossing bend lines that can provide either a fixed-angle bend or a "living hinge".

The main rear panel 12A along with the two side panels 12B and bottom panel 12F can be made integrally from a single flat sheet. The side panels 12B attached perpendicularly to rear panel 12A at the corners along a bend line, form adjustable arm rests by pivotal attachment to forward armrest portions 12C that are each configured with a vertical "living hinge" indicated by a broken line, to allow interspacing adjustment between the front ends 14A of the armrests 14.

Figure 3:
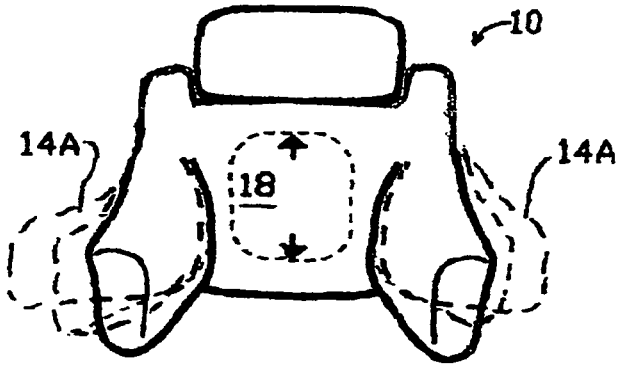
FIG. 3 is a perspective front view of the lounge of FIG. 1 indicating the adjustable armrest spacing.

FIG. 3 is a perspective front view of the lounge of FIG. 1 showing in broken lines three alternative positions of forward arm portions 14A in the range of variable spacing available. Also indicated in broken lines, a rear region 18 provides for location of a back pillow that can be made vertically adjustable as indicated by the arrows.

Figure 4:
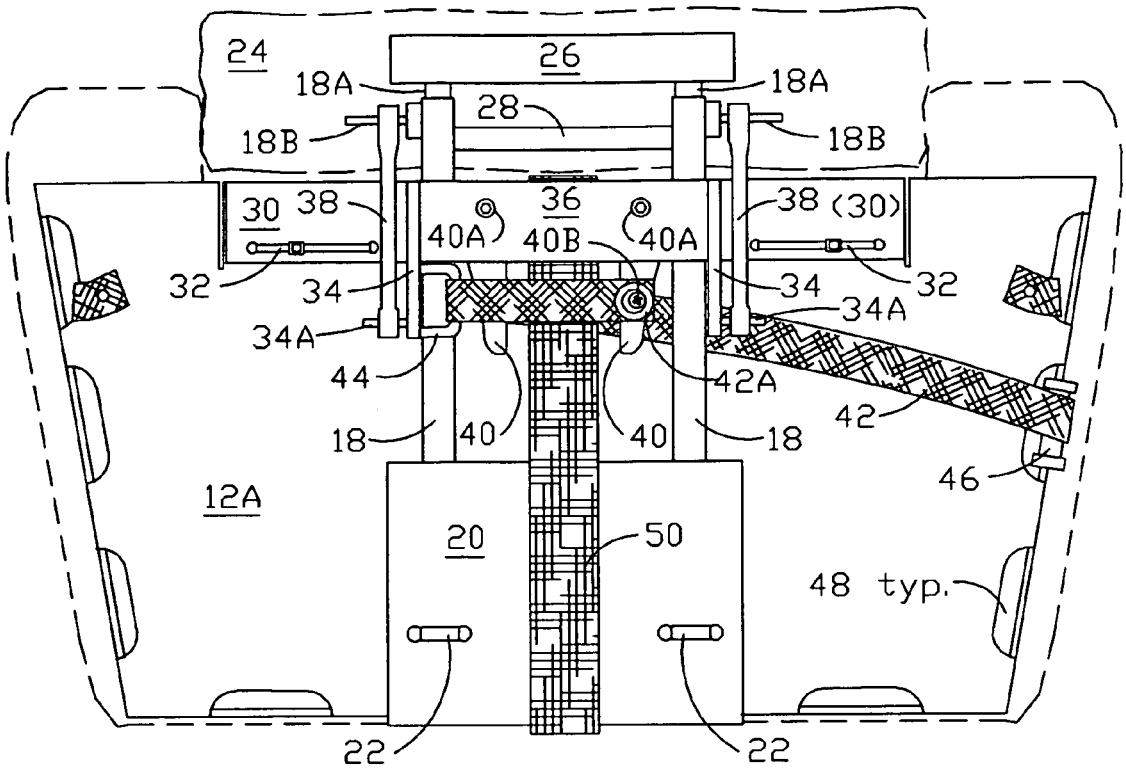
FIG. 4 is an enlarged rear view of the basic seat assembly of the lounge (FIG. 2) showing the main components of the reclining mechanism, indicating the outline of the padding and slip cover in broken lines.

FIG. 4 is an enlarged rear view of the of the seat assembly 12 of FIG. 2 with the padding and slip cover indicated in broken outline but otherwise removed to show the main structure and components of the reclining mechanism. A pair of vertical columns 18 extend from the bottom region where they are secured to the flat rear panel portion of tailpiece 20 by nylon lock-tie loops 22.

At the upper end, headrest 24 is attached via a cylindrical headrest crossbar 26 to a pair of telescoping members 18A extending from the upper ends of columns 18 to allow vertical adjustment of the headrest 24. Columns 18 are typically made from steel in a modified U shape cross-sectional shape, but could optionally be made round, rectangular or square. The two columns 18 are secured together at a desired parallel separation by an upper cross-member 28.

A metal plate 30 is fastened via nylon lock-tie loops 32 to a similar-sized attachment flap formed by cutaways at each end in a central upper region of the rear panel 12A. The attachment flap is hinged along its bottom edge by a "living hinge" in rear panel 12A to provide flexure required over the reclining range.

Plate 30 forms the base element of a slidable assembly 30-36 which includes a pair of side plates 34 attached to rear plate 36 and a rear plate 36 attached to side plates 34, forming a rectangular cross-section that is dimensioned to fit closely around the two columns 18 with only sufficient horizontal clearance to allow the slidable assembly 30-36 to be shifted vertically relative to columns 18, as required to enable inclination adjustment. When secured to slidable assembly 30-36 in the normal mode, columns 18, supported at bottom by attachment to tailpiece 20, provide the main-rear support of the lounge, particularly when reclined.

Side plates 34 are each fitted with a pin 34A extending outwardly and engaging the lower ends of a pair of rubber stretch members 38 whose upper ends engage pins 18B, extending outwardly from the upper region of columns 18. Stretch members 38 are dimensioned to be only slightly tensioned when the slidable assembly 30-36 is located at the upper end of its travel range as shown in the upright condition. The span of stretch members 38 and the tension increase as the slidable assembly 30-36 moves downwardly on columns 18 toward the lower end of its travel range as the inclination increases, thus providing a counter-balance force that works in conjunction with the role of the user's body position and weight during the adjustment of inclination by the user in a seated position.

A mirror-image pair of lever-cams 40, of which only lower end portions are visible in this view, are pivotally attached to rear plate 36 by fasteners 40A such as rivets, screws, pins or eyelets.

A fabric user control strap 42, typically 1 inch wide woven webbing, is fitted with a first grommet 42A that engages a drive pin 40B set into the lever-cam 40 as shown. Strap 42 passes thru a metal slide/guide 44 fastened to the side plate 36 to the left in FIG. 4, where strap 42 is rerouted 180 degrees and, in a return portion not visible in this view, similarly engages the other lever-cam (40), thence extending to and passing around a slide/guide 46 at the corner of rear panel 12A, thence leading forward beneath the padding to a forward slip cover exit location where that end of strap 42 is formed into the loop handle (see FIG. 1) for the user to manipulate for inclination adjustment. Slide/guide 46 is located at one of the openings 48 that are provided as part of the bend lines at the corner edges of the rear panel 12A.

A fabric support strap 50, typically a woven webbing 2 inches wide, is visible only in part in FIG. 4, extending over the top of the rear panel 12 and under the tailpiece 20.

Figure 5:
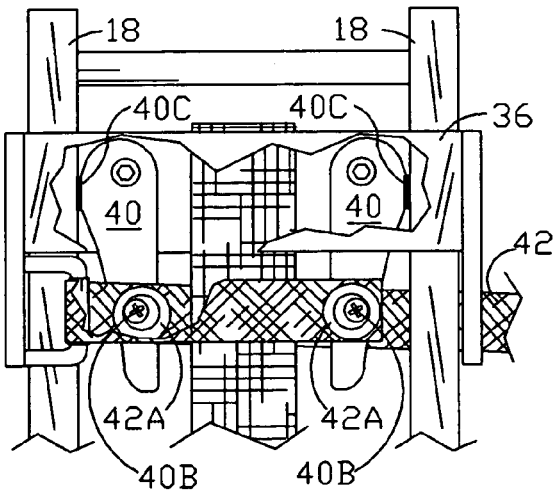
FIG. 5 is a further enlarged view of a portion of FIG. 4 in the normal mode, with cutaways to show the dual lever-cam mechanism automatically gripping the columns and thus holding the setting of the inclination.

FIG. 5 is an enlarged view of an upper central portion of FIG. 4, with rear plate 36 shown partially cut away to expose both lever-cams 40, each configured with a drive pin 40B on the lever portion engaging a corresponding grommet 42A in strap 42. Each lever-cam 40 is configured with a resilient friction pad 40C affixed to the cam edge, made and arranged to provide gripping action against columns 18.

In the normal mode, as shown, friction pads 40C are strongly forced against columns 18 by the torque of steel springs (not visible in this view), causing the cam action to grip the slidable assembly 30-36 securely to the columns 18 thus "locking in" the currently-set inclination. Part of strap 42 is shown cut away to show engagement of the other lever-cam 40 to strap 42 via drive pin 40B and grommet 42A. In this normal mode, strap 42, simply resting slack and unattended, applies no force to the lever-cams 40, thus the friction pads 40C are held gripping the columns 18 by spring bias.

Figure 6:
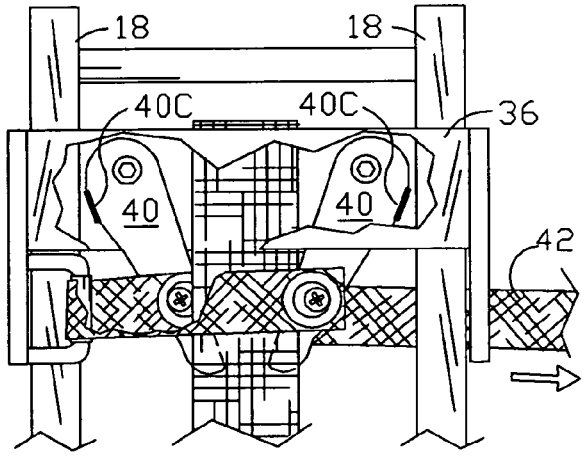
FIG. 6 shows the subject matter of FIG. 5 in the adjustment mode with the control strap being pulled by the user to rotate the lever-cams, releasing the gripping and thus allowing adjustment of the inclination.

FIG. 6 shows the subject matter of FIG. 5 with the control strap 42 pulled by the user in the direction of the arrow to initiate the adjustment mode. The displacement of strap 42 rotates the lever-cams 40 equally in opposite directions, as shown, overcoming the spring torque and disengaging the friction pads 40C from columns 18 thus allowing slidable assembly 36 to be shifted along columns 18 for adjusting the inclination of the lounge.

The user maintains tension on the strap 42 to keep the friction pads 40C held clear while the weight and shape variations in the user's body are utilized to shift slidable assembly 36 and thus adjust the lounge to a desired inclination; then when strap 42 is released to re-enter the normal mode, the cam griping action is restored thus holding the lounge at the selected inclination.

Figure 7:
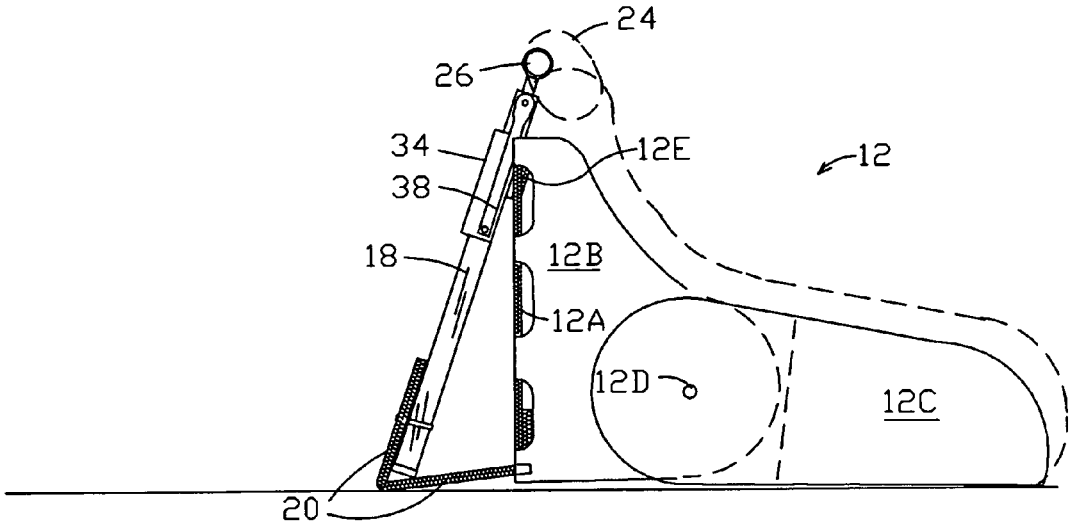
FIG. 7 is a side elevation view of the seat assembly adjusted to the fully upright setting.

FIG. 7 is a side elevation view of the main framework components shown adjusted to the upright condition. Rear panel 12A is vertical and armrests 12C are set to the location shown relative to side panels 12B through swivel action about pivot points 12D. Support columns 18, attached at bottom to tailpiece 20, are attached to rear panel 12A via slidable assembly (30-36) of which end plate 34 is visible, and which is secured to attachment flap 12E, inclined as shown at its "living hinge" line.

In this upright condition, the slidable assembly 30-36 is located at the top end of its travel range, gripped in place there by the cams as previously described, and thus the two stretch members 38 are only slightly tensioned. For clarity, neither of the fabric straps are shown in FIGS. 7 and 8.

Figure 8:
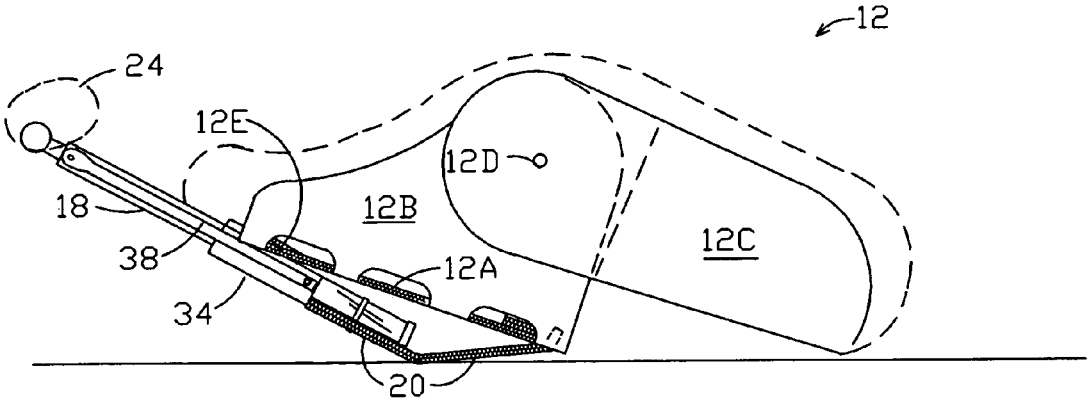
FIG. 8 shows the subject matter of FIG. 7 after readjusting the seat assembly to the maximally reclined setting.

FIG. 8 depicts the subject matter of FIG. 7 with the seat assembly 12 having been readjusted to the maximally reclined condition. Rear panel 12A is now inclined about 70 degrees from vertical. Armrests 12C are reset to the location shown relative to side panels 12B through swivel action about pivot points 12D. The slidable assembly (30-36), as indicated by the changed location of end plate 34, is now at the bottom end of its travel range, and the two stretch members 38 are maximally stretched as shown.

In order to increase the inclination, e.g. from the upright position of FIG. 7 to the fully reclined position of FIG. 8, the user need only pull on strap (42) to release the gripping action and then push against the rear panel 12A with body weight to tilt the lounge to the desired angle of inclination and then release the strap (42) to restore the gripping action and hold the inclination at the selected angle.

To decrease the inclination, the user leans forward to remove body weight from the main frame assembly, allowing the tension in stretch members 38 to overcome the torque caused by the combined weight of all components including the headrest 24 to the left side of the hinge point at the corner of tailpiece 20, and cause these components to automatically rotate counterclockwise to a lesser inclination. Without stretch members 38, this weight would prevent this automatic restoration to lesser inclination: the rear portion would have to be lifted manually.

Figure 9:
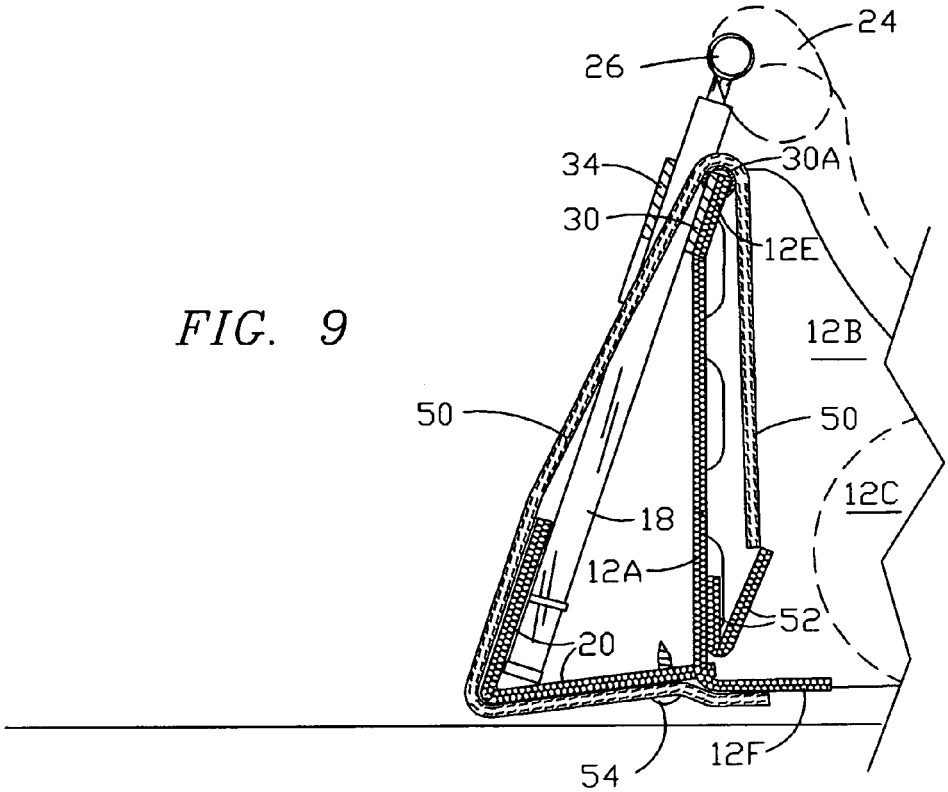
FIG. 9 is a central cross-section corresponding to FIG. 7.

FIG. 9 is an enlarged central cross-section corresponding to FIG. 7, i.e. in the upright condition, showing the fabric support strap 50 with an end attached by two screws 54 to a bottom front region of tailpiece 20, extending along the underside thereof and upwardly past the rear panel of tailpiece 20 to a slider at the top of attachment flap 12E of rear panel 12A thence downwardly to the other end which is attached to a hinged panel 52 that is attached to rear panel 12A, extending full width thereof and held at an upward angle as shown. Beneath hinged panel 52, a bottom panel 12F formed as a continuation of rear panel 12A, is attached at its ends to side panels 12B.

Figure 10:
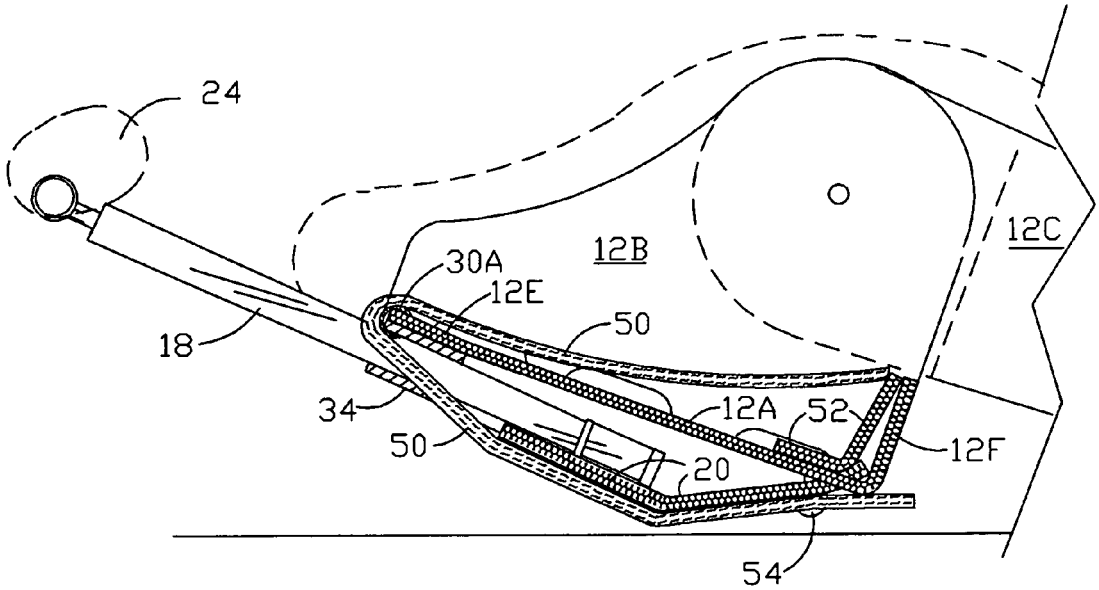
FIG. 10 is a central cross-section corresponding to FIG. 8.

FIG. 10 is an enlarged cross-section corresponding to FIG. 8, i.e. in the fully reclined condition. Slidable assembly (30-36), as indicated by the location of end plate 34, is now at the bottom end of its travel range. Fabric support strap is now sagging in a slack condition, allowing hinged panel 52 to now open to a much larger angle and rest against bottom panel 12F.

A generally rectangular bottom padding cushion, typically made 2 to 3 inches in thickness, is held in place by adjustable webbing straps that may be secured to the main relatively rigid three-dimensional seat structure formed by rear panel, side panels 12B and bottom panel 12F all fastened together as a unit. The user's weight, transmitted to the bed or other basic support region via this seat structure, holds the lounge stabilized in place for any setting of inclination, while the tensile and compressive forces in the various components form a robust but lightweight and easily user-adjusted overall unit.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A reclining free-standing bed lounge, that is portable and adjustable by a seated user to a desired inclination, and that requires no external support structure other than a flat horizontal basic support surface, comprising:

a generally rigid three dimensional seat assembly having, a flat rear panel with a predetermined width dimension flanked by and contiguous with a pair of flat side panels extending substantially perpendicularly therefrom by a side dimension smaller than the rear panel width dimension, and a bottom panel disposed substantially perpendicular to the rear panel and the side panels, extending forward from a bottom edge of the rear panel by less than half of the predetermined side dimension; the side panels being generally vertical and the bottom panel being made to remain generally horizontal as supported from the basic support surface;

a tailpiece having at least a substantially horizontal bottom portion with a front edge attached hingedly to a lower edge region of the rear panel extending rearwardly to a rear edge;

an elongate rear support beam assembly having at least a prop portion thereof, made variable in length, extending between a lower end thereof, fixedly attached to a rear location of said tailpiece, and an upper end of the prop portion, hingedly attached to an upper location of the rear panel, forming, along with the rear panel and said tailpiece bottom portion, a triangle having a substantially horizontal base side of fixed length formed by the bottom portion of said tailpiece, subtending a second side of fixed length formed by the rear panel, and a third side of variable length formed by the prop portion of said rear support beam assembly, the three sides of the triangle thus formed being dimensioned such that at a predetermined maximum length of the prop portion, the rear panel is made to be substantially vertical, perpendicular to the basic support surface, constituting an upright chair-shaped orientation of said seat assembly, whereas with the prop portion shortened to a predetermined minimum length, the rear panel becomes maximally reclined through rotation of said seat assembly about an axis of rotation along the bottom edge of the rear panel, constituting a maximally reclined orientation of said seat assembly;

prop-length-fixing means incorporated in said rear support beam assembly made and arranged to effectively fix the prop portion at a user-selected length in a range bounded by the predetermined maximum and minimum lengths and to continue holding the user-selected length as a default condition in the absence of user intervention for purposes of release and adjustment; and user release control means made and arranged to enable the user, from a seated position in said bed lounge, to temporarily over-ride and release said prop-length-fixing means so as to allow the user to readjust said seat assembly to a desired inclination by varying the effective length of the prop portion.

2. The reclining free-standing bed lounge as defined in claim 1 wherein said tailpiece further comprises a rear panel portion hingedly attached along the rear edge of the bottom portion, and wherein said rear support beam assembly comprises:

a pair of metal columns, having lower ends thereof attached to the rear panel portion of said tailpiece, disposed symmetrically about a central axis of the seat assembly parallel to each other and made greater in length than the predetermined maximum length of the prop portion;

a slidable assembly hingedly attached to an upper region of said rear panel, made and arranged to surround each of said pair of metal columns of said support beam assembly in a manner to be slidable longitudinally relative thereto so as to enable the prop portion to be varied in length and thus the seat assembly to be rotated and inclined within the predetermined range.

3. The reclining free-standing bed lounge as defined in claim 2 further comprising:

a headrest, attached to upper ends of said metal columns.

4. The reclining free-standing bed lounge as defined in claim 3 wherein said headrest is attached to upper ends of said metal columns via a pair of telescopic extension members extending into corresponding openings in the upper ends of said metal columns, made and arranged to enable height adjustment of said headrest.

5. The reclining free-standing bed lounge as defined in claim 2 wherein said prop-length-fixing means comprises:

a pair of lever-cams each configured with a resilient friction pad made and arranged to press against said columns and thus grip and fix said slidable assembly against movement relative to said columns in response to rotation of said lever-cams in a first direction; and spring means, engaging said lever-cams, made and arranged to strongly urge said lever-cams to rotate in the first direction and thus hold said slidable assembly gripped to said columns in a default condition absent user intervention, thus holding said seat assembly at a previously user-selected inclination.

6. The reclining free-standing bed lounge as defined in claim 5 wherein said user release control means comprises:

a fabric strap, coupled to a lever portion of each of said lever-cams and directed by slide/guide means to a location convenient for manipulation by the user while seated in said bed-lounge, made and arranged to rotate said lever-cams in a second and opposite direction in response to the user pulling said fabric strap, so as to move said friction pads clear of said columns and thus temporarily release gripping and allow said slidable assembly to move along said columns for purposes of user-adjustment of inclination of said seat assembly.

7. The reclining free-standing bed lounge as defined in claim 5 further comprising:

automatic recline-canceling force means made and arranged to continuously apply force urging said seat assembly to rotate in a direction toward the upright chair-shaped orientation, the force being made sufficient that, upon and during deployment of said user release control means and removal of body weight from the rear panel by the user, said seat assembly will be caused to rotate automatically from any inclination in the direction toward the upright chair-shaped orientation, whereupon the user is enabled to select a new inclination by restoring body weight on the rear panel and terminating actuation of said user release control means, thus causing the new inclination to be maintained.

8. The reclining free-standing bed lounge as defined in claim 7 wherein said automatic recline-canceling force means comprises:

a pair of elastic members each having a first end attached to a top region of a corresponding one of said columns and having a second and opposite end attached to a corresponding side location on said slidable assembly.

9. The reclining free-standing bed lounge as defined in claim further comprising:

padded lining material covering selected areas of said seat assembly;

a seat cushion attached by straps to said seat assembly, a fabric slip cover, enclosing said padded material, said seat assembly and said seat cushion, said fabric slip cover made removable for cleaning purposes.

* * * * *